US012426716B2

(12) United States Patent
Chen et al.

(10) Patent No.: US 12,426,716 B2
(45) Date of Patent: Sep. 30, 2025

(54) FOLDING SOFA BED

(71) Applicant: JIAXING REST FURNITURE & APPLIANCE CO., LTD., Zhejiang (CN)

(72) Inventors: Jiguan Chen, Zhejiang (CN); Bing Chen, Zhejiang (CN); Qiangqiang Wu, Zhejiang (CN); Baoli Zhang, Zhejiang (CN); Chong Ma, Zhejiang (CN)

(73) Assignee: JIAXING REST FURNITURE & APPLIANCE CO., LTD., Zhejiang (CN)

( * ) Notice: Subject to any disclaimer, the term of this patent is extended or adjusted under 35 U.S.C. 154(b) by 30 days.

(21) Appl. No.: 18/213,238

(22) Filed: Jun. 22, 2023

(65) Prior Publication Data

US 2024/0324784 A1 Oct. 3, 2024

(30) Foreign Application Priority Data

Mar. 30, 2023 (CN) ..... 202310328894.6

(51) Int. Cl.
*A47C 17/175* (2006.01)
*A47C 17/17* (2006.01)

(52) U.S. Cl.
CPC ..... *A47C 17/1756* (2013.01); *A47C 17/175* (2013.01); *A47C 17/17* (2013.01)

(58) Field of Classification Search
CPC ... A47C 17/1756; A47C 17/175; A47C 17/17; A47C 17/13; A47C 17/132; A47C 17/134; A47C 17/136; A47C 17/138
USPC ..... 5/47, 48, 28, 29, 31, 35, 36
See application file for complete search history.

(56) References Cited

U.S. PATENT DOCUMENTS 1,078,909 A * 11/1913 Fischrupp ..... A47C 17/23 5/55.1
1,118,556 A * 11/1914 Kindel ..... A47C 17/225 5/55.1
1,334,768 A * 3/1920 Luppino ..... A47C 17/20 5/59.1
1,519,674 A * 12/1924 Dyke ..... A47C 17/225 5/12.2
1,626,801 A * 5/1927 Fichtenbaum ..... A47C 17/225 5/56
1,798,462 A * 3/1931 Frank ..... A47C 17/20 5/31
1,820,167 A * 8/1931 Taffel ..... A47C 17/225 5/59.1

(Continued)

FOREIGN PATENT DOCUMENTS

WO WO-2013059309 A2 * 4/2013 ..... A47C 17/17

*Primary Examiner* — Robert G Santos
(74) *Attorney, Agent, or Firm* — Global IP Services; Tianhua Gu

(57) ABSTRACT

Disclosed is a folding sofa bed, including a folding bed frame body, a cushion body, and a turning component. The cushion body is disposed above the folding bed frame body. The turning component is connected with the folding bed frame body and the cushion body. The turning component is capable of driving the cushion body above the folding bed frame body to turn to be below the folding bed frame body. In this application, when the folding sofa bed is unfolded, the cushion body may turn to be below the folding bed frame body through the turning component. This may not only save space, but also bring convenience to a user for operation.

2 Claims, 5 Drawing Sheets

(56) References Cited

U.S. PATENT DOCUMENTS

| | | | | | |
|---|---|---|---|---|---|
| 1,850,262 | A * | 3/1932 | Fichtenbaum | A47C 17/225 | 5/59.1 |
| 2,827,640 | A * | 3/1958 | Goodman | A47C 17/225 | 5/55.1 |
| 8,893,323 | B2 * | 11/2014 | Garland | A47C 17/17 | 5/42 |
| 2013/0097774 | A1 * | 4/2013 | Garland | A47C 17/17 | 5/29 |
| 2024/0324784 | A1 * | 10/2024 | Chen | A47C 17/1756 | |

* cited by examiner

FOLDING SOFA BED

TECHNICAL FIELD

This application relates to a sofa bed, and in particular, to a folding sofa bed.

BACKGROUND

A Bed is one of the essential household items in people's home life. However, a bed usually occupies a large area, and often occupies very considerable living space. To improve reasonable area use, people obtain larger activity space by improving a method for using a bed. Therefore, the sofa bed industry emerges.

During implementation of this application, the applicant finds that when a current sofa bed is unfolded, a sofa cushion is located above a folding bed frame, and the sofa cushion above the bed frame is required to be removed manually. This is cumbersome in operation. In addition, the removed sofa cushion occupies the rest of space, bringing inconvenience to a user.

SUMMARY

An embodiment of this application provides a folding sofa bed, to solve the problem that a cushion body is above a folding bed frame when an existing sofa bed is unfolded.

To solve the foregoing technical problem, this application is implemented as follows.

A first aspect provides a folding sofa bed, including a folding bed frame body, a cushion body, and a turning component. The cushion body is disposed above the folding bed frame body. The turning component is connected with the folding bed frame body and the cushion body. The turning component is capable of driving the cushion body above the folding bed frame body to turn to be below the folding bed frame body.

In this embodiment of this application, the turning component is additionally disposed between the folding bed frame body and the cushion body. When the folding sofa bed is unfolded, the cushion body may turn to be below the folding bed frame body through the turning component. This may not only save space, but also bring convenience to a user for operation.

BRIEF DESCRIPTION OF THE DRAWINGS

The accompanying drawings described herein are used to provide a further understanding of this application, and constitute a part of this application. Exemplary embodiments of this application and illustrations thereof are used to explain this application, and do not constitute an improper limitation to this application. In the drawings.

DETAILED DESCRIPTION

To make objectives, technical solutions, and advantages of this application clearer, the following further describes implementations of the present disclosure in detail with reference to the accompanying drawings.

"First", "second", and the like used herein do not indicate a particular order or succession, and are not intended to limit this application but only to distinguish between components or operations described with the same technical term.

Figure 1:
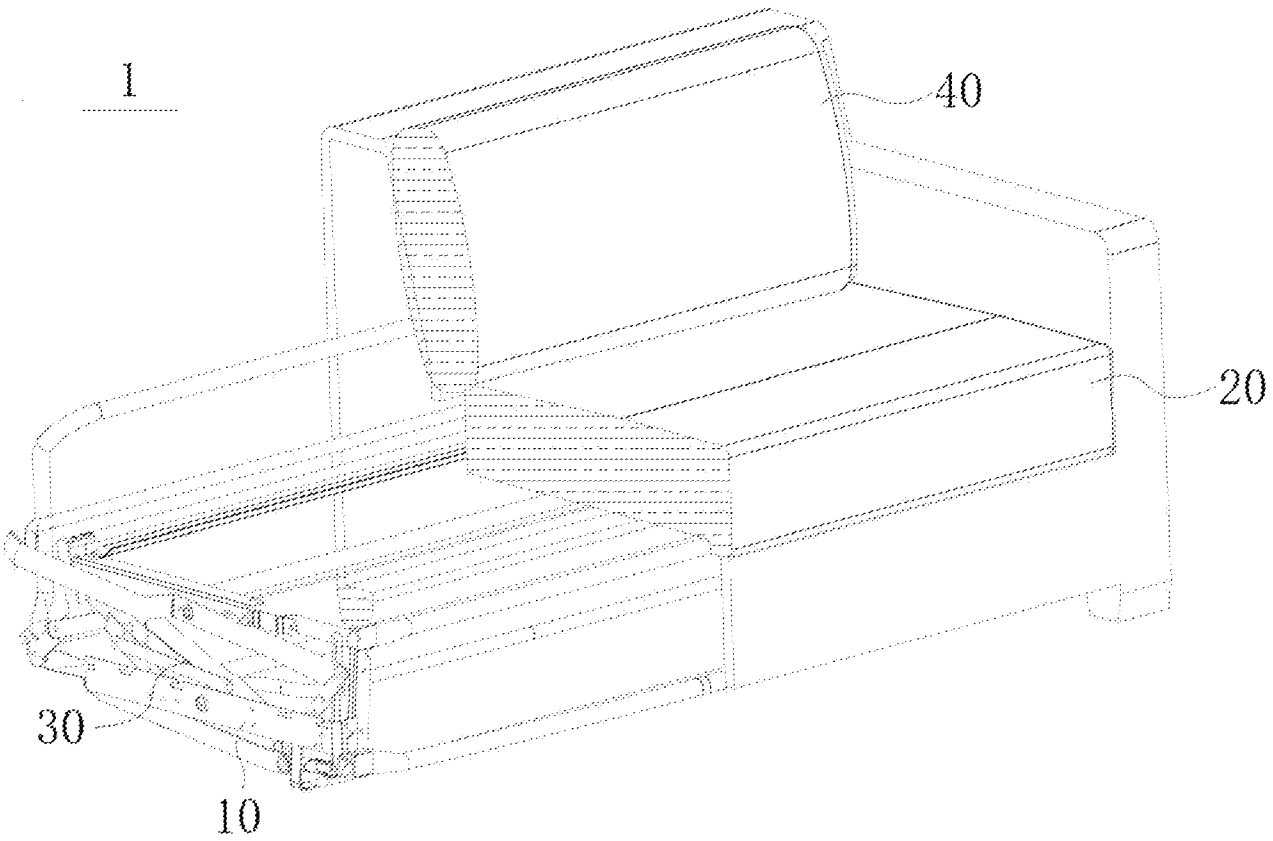
FIG. 1 is a partial sectional view of a folding sofa bed according to an embodiment of this application.
Figure 2:
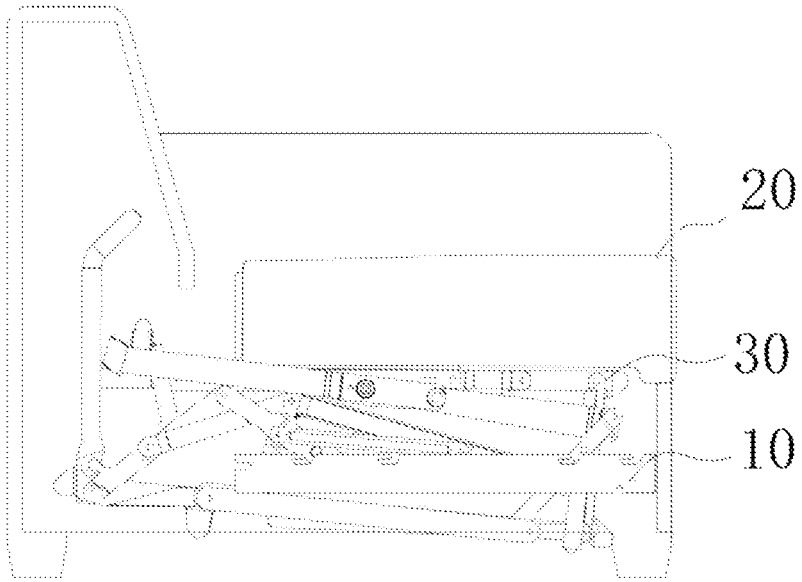
FIG. 2 is a schematic diagram of the folding sofa bed in a folded state according to an embodiment of this application.
Figure 3:
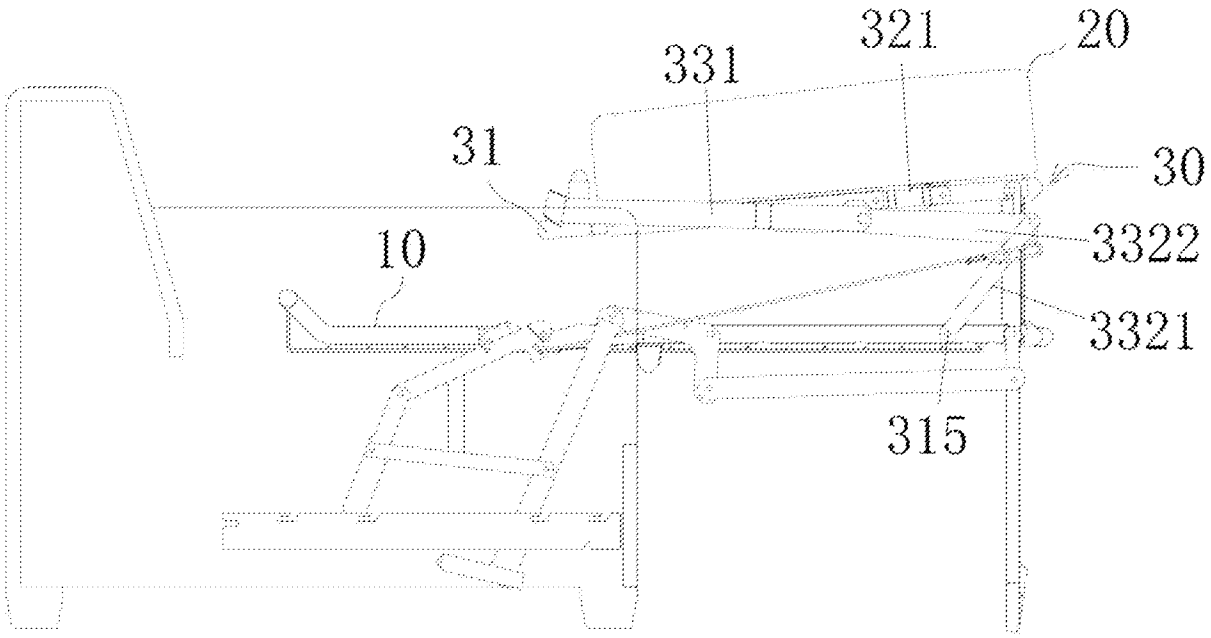
FIG. 3 is a schematic diagram of the folding sofa bed in a semi-unfolded state according to an embodiment of this application.
Figure 4:
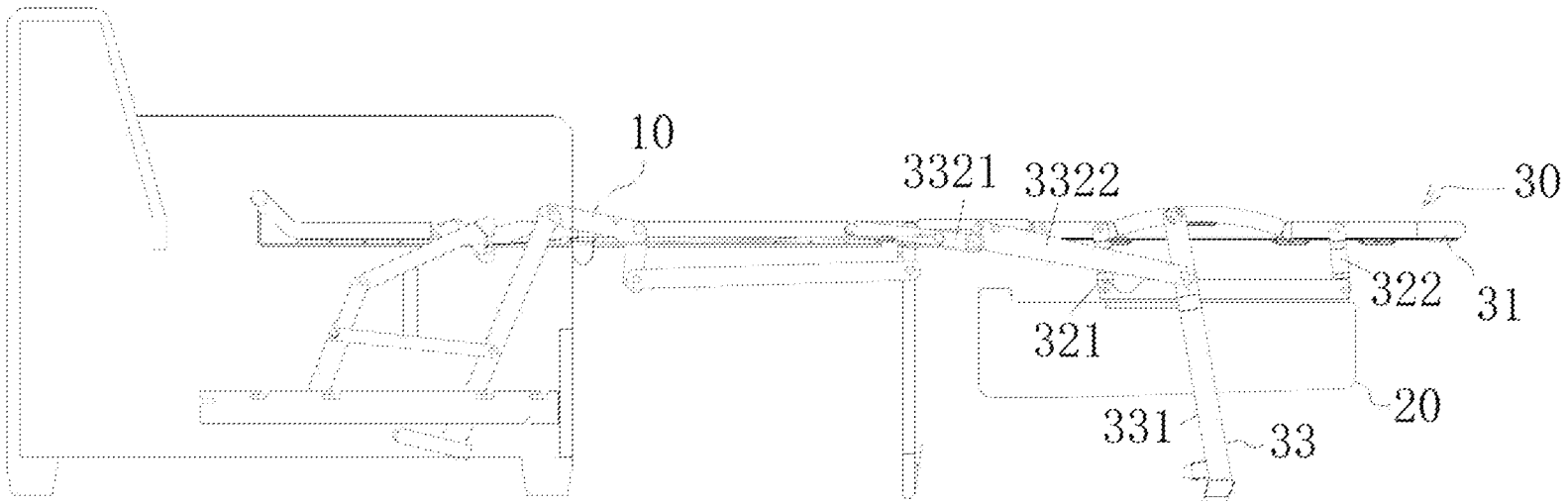
FIG. 4 is a schematic diagram of the folding sofa bed in a completely unfolded state according to an embodiment of this application.

Refer to FIG. 1 to FIG. 4. FIG. 1 is a partial sectional view of a folding sofa bed according to an embodiment of this application. FIG. 2 to FIG. 4 are respectively schematic diagrams of the folding sofa bed in a folded state, a semi-unfolded state, and a completely unfolded state according to an embodiment of this application. As shown in the figures, the folding sofa bed 1 includes a folding bed frame body 10, a cushion body 20, and a turning component 30. The cushion body 20 is disposed above the folding bed frame body 10. In this embodiment, the folding bed frame body 10 has an unfolded state and the folded state. When the folding bed frame body 10 is in the unfolded state, the folding sofa bed 1 is a bed for a user to lie on to have a rest. When the folding bed frame body 10 is in the folded state, the folding sofa bed 1 is a sofa for a user to sit on to have a rest.

The turning component 30 is connected with the folding bed frame body 10 and the cushion body 20. The turning component 30 is capable of driving the cushion body 20 above the folding bed frame body 10 to turn to be below the folding bed frame body 10. Therefore, when the folding sofa bed 1 is unfolded, the user may turn the cushion body 20 to be below the folding bed frame body 10 through the turning component 30. This may not only save space, but also bring convenience to the user for operation.

In this embodiment, as shown in FIG. 2, when the folding sofa bed 1 is in the folded state, the folding bed frame body 10 is in the folded state, the cushion body 20 is above the folding bed frame body 10, and the turning component 30 is folded and stored between the folding bed frame body 10 and the cushion body 20. In this case, the folding sofa bed 1 is a sofa.

When the folding bed frame body 10 is in the unfolded state, the turning component 30 is turnable between a first state and a second state. As shown in FIG. 3, when the folding sofa bed 1 is in the semi-unfolded state, the folding bed frame body 10 is in the unfolded state, and the turning component 30 is in the first state. In this case, the cushion body 20 is above the folding bed frame body 10, and the turning component 30 is folded between the folding bed frame body 10 and the cushion body 20. As shown in FIG. 4, when the folding sofa bed 1 is in the completely unfolded state, the folding bed frame body 10 is in the unfolded state, and the turning component 30 is in the second state. In this case, the cushion body 20 is below the folding bed frame body 10, the turning component 30 is in the unfolded state, and an upper portion of the turning component 30 is flush with the folding bed frame body 10 and above the cushion body 20.

It is to be noted that this application mainly claims for protection of the turning component 30 in the technical solution in which the turning component 30 is capable of turning the cushion body 20 above the folding bed frame body 10 to be below the folding bed frame body 10. A person skilled in the art may select specific structures of the folding bed frame body 10 and the cushion body 20 as actually required, and there is no special requirement on this in this application. Therefore, the structures of the folding bed frame body 10 and the cushion body 20 will not be elaborated in this application.

The following describes a structure of the turning component 30 in this embodiment of this application in detail. In this embodiment, there are disposed two turning components 30. The two turning components 30 are on two opposite sides of the cushion body 20. One end of each of the two turning components 30 is pivoted to the folding bed frame body 10. The other ends of the two turning components 30 rotate around the pivoting ends of the turning components, thereby driving the cushion body 20 to turn. In this way, turning stability of the cushion body 20 may be improved.

Figure 5:
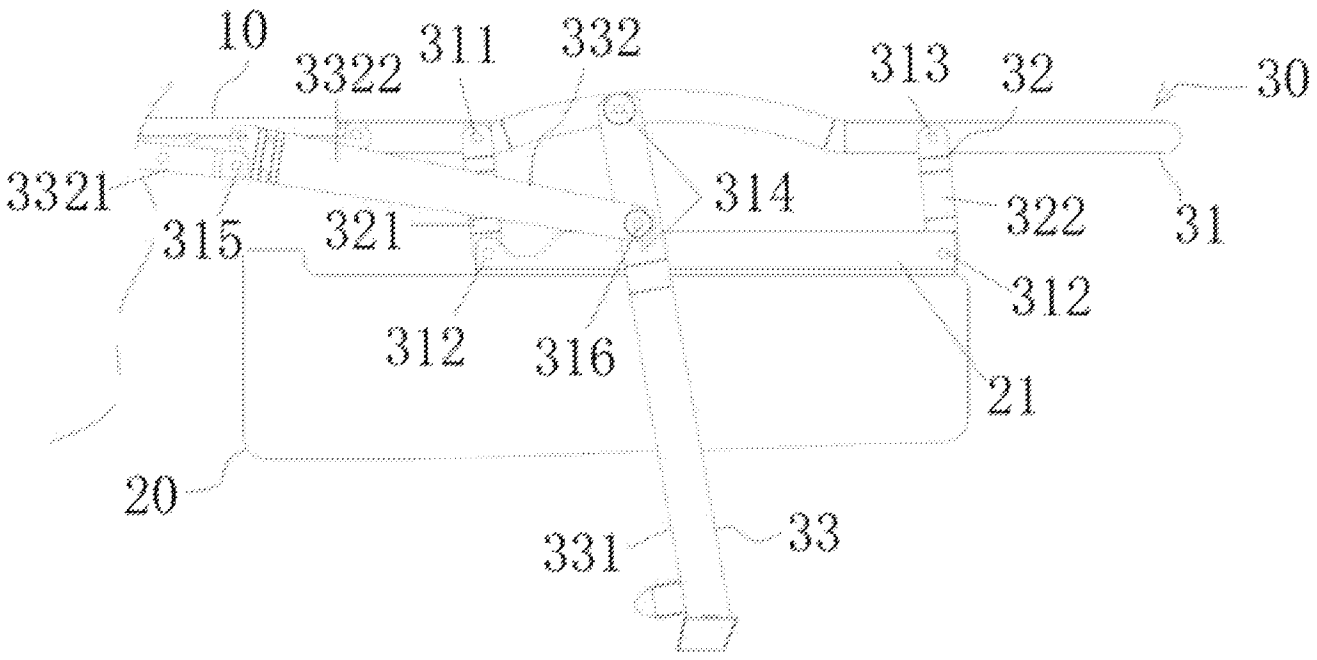
FIG. 5 is a partial schematic diagram of the folding sofa bed according to an embodiment of this application.

Refer to FIG. 5 together. FIG. 5 is a partial schematic diagram of the folding sofa bed according to an embodiment of this application. As shown in the figure, each turning component 30 includes a driving member 31 and a linkage member 32. One end of the driving member 31 is pivoted to the folding bed frame body 10. The other end of the driving member 31 is a driving end. In this embodiment, the driving member 31 may be pivoted to the folding bed frame body 10 in a manner that a first pivoting rod 311 is disposed on the pivoting end of the driving member 31 and the folding bed frame body 10 in a penetration manner. In this embodiment, the driving member 31 is but is not limited to a front round tube of a folding bed frame.

One end of the linkage member 32 is pivoted to the cushion body 20. The other end of the linkage member 32 is pivoted to the driving member 31. The linkage member 32 includes a first connecting rod 321 and a second connecting rod 322. One end of the first connecting rod 321 is pivoted to the cushion body 20. One end of the second connecting rod 322 is pivoted to the cushion body 20. In this embodiment, a connecting rod 21 is disposed on a side of the cushion body 20 adjacent to the folding bed frame body 10. The first connecting rod 321 and the second connecting rod 322 are pivoted to the connecting rod 21. In this embodiment, ends, pivoted to the connecting rod 21, of the first connecting end 321 and the second connecting rod 322 are respectively at the two ends of the connecting rod 21. In this embodiment, the first connecting rod 321 and the second connecting rod 322 may be pivoted to the cushion body 20 in a manner that a second pivoting rod 312 is disposed on one end of each of the first connecting rod and the second connecting rod and the connecting rod 21 in the penetration manner.

From the above, the other end of the first connecting rod 321 is pivoted to the driving member 31. The other end of the second connecting rod 322 is pivoted to the driving member 31. The first connecting rod 321 and the second connecting rod 322 are disposed side by side. In this embodiment, the first connecting rod 321 may be pivoted to the driving member 31 in a manner that the first pivoting rod 311 is disposed on the other end of the first connecting rod in the penetration manner. The second connecting rod 322 may be pivoted to the driving member 31 in a manner that a third pivoting rod 313 is disposed on the other end of the second connecting rod and the driving member 31 in the penetration manner. In this embodiment, the first connecting rod 321 and the second connecting rod 322 are disposed, so that the turning stability of the cushion body 20 may be improved. In this embodiment, both the first connecting rod 321 and the second connecting rod 322 use but are not limited to flat short rods.

When the other end of the driving member 31 rotates around the pivoting end of the driving member, the driving member 31 drives, through the linkage member 32, the cushion body 20 to turn. As shown in FIG. 3, when the turning component 30 is in the first state, the driving member 31 is below the cushion body 20 and above the folding bed frame body 10, and the driving member 31 overlaps the first connecting rod 321 and the second connecting rod 322. As shown in FIG. 4, when the other end (the driving end) of the driving member 31 rotates counterclockwise around the pivoting end of the driving member to the second state, the driving end of the driving member 31 is flush with the folding bed frame body 10, and the driving member 31 simultaneously drives the cushion body 20 to turn to be below the folding bed frame body 10, and in addition, the first connecting rod 321 and the second connecting rod 322 are unfolded relative to the driving member 31 and located between the driving member 31 and the cushion body 20. On the contrary, when the driving end of the driving member 31 rotates clockwise around the pivoting end of the driving member to the first state, the driving member 31 simultaneously drives the cushion body 20 to turn to be above the folding bed frame body 10.

Each turning component 30 further includes a stopper 33. One end of the stopper 33 is pivoted to the driving member 31. The other end of the stopper 33 is pivoted to the folding bed frame body 10. The stopper 33 is configured to stop the driving member 31 such that the driving member rotates between the first state and the second state. In this embodiment, the stopper 33 includes a supporting rod 331 and a driven rod 332. One end of the supporting rod 331 is pivoted to the driving member 31. A middle position of the supporting rod 331 is further pivoted to the cushion body 20. In this embodiment, the middle position of the supporting rod 331 is pivoted to the connecting rod 21 on the cushion body 20. In this embodiment, the supporting rod 331 may be pivoted to the driving member 31 and the cushion body 20 in a manner that a fourth pivoting rod 314 is respectively disposed on a body of the supporting rod, the driving member 31, and the connecting rod 21 in the penetration manner. In this embodiment, the supporting rod 331 uses but is not limited to a supporting leg corresponding to the folding bed frame.

One end of the driven rod 332 is pivoted to the folding bed frame body 10. The other end of the driven rod 332 is pivoted to the middle position of the supporting rod 331. In this embodiment, the driven rod 331 includes a short rod 3321 and a long rod 3322. One end of the short rod 332 is pivoted to the folding bed frame body 10. The other end of the short rod 3321 is pivoted to one end of the long rod 3322. The other end of the long rod 3322 is pivoted to the middle position of the supporting rod 331. In this embodiment, the short rod 3321 may be pivoted to the folding bed frame body 10 and the long rod 3322 in a manner that a fifth pivoting rod 315 is disposed on a body of the short rod, the folding bed frame body 10, and the long rod 3322 in the penetration manner. The long rod 3322 may be pivoted to the supporting rod 331 in a manner that a sixth pivoting rod 316 is disposed on a body of the long rod and the supporting rod 331 in the penetration manner.

As shown in FIG. 4, the turning component 30 is in the second state, and the other end of the supporting rod 331 is obliquely pressed against a ground to support the driving member 31, such that the driving end of the driving member 31 is flush with the folding bed frame body 10, and the unfolding stability is ensured. In addition, the supporting rod 331, the driven rod 332, and the driving member 31 form a triangle, so that supporting stability of the supporting rod 331 may be improved. In this case, the short rod 3321 and the long rod 3322 tend to be a straight line, and the driving member 31 is in a maximum clockwise rotation state under a stopping action of the short rod 3321 and the long rod 3322, so that the driving member 31 at a maximum clockwise rotation angle is stopped in the second state.

When the driving end of the driving member 31 rotates counterclockwise around the pivoting end of the driving member, the driving member 31 drives the supporting rod 331 to rotate upwards, and the driven rod 332 is linked with the supporting rod 331 to rotate clockwise. As shown in FIG. 3, when the driving member 31 rotates to the first state, the supporting rod 331 and the long rod 3322 partially overlap and tend to be a straight line, and the driving member 31 is in a maximum counterclockwise rotation state under a stopping action of the supporting rod 331 and the long rod 3322, so that the driving member 31 at a maximum counterclockwise rotation angle is stopped in the first state. Therefore, the driving member 31 is stopped to rotate between the first state and the second state through linkage between the supporting rod 331 and the short rod 3321 and the long rod 3322.

In this embodiment, referring a back to FIG. 1, the folding sofa bed 1 further includes back cushion 40. The back cushion 40 is disposed at a backrest of the folding bed frame body 10. Therefore, when the folding sofa bed 1 is a sofa for the user to sit on to have a rest, comfort of the user in sitting may be improved. In addition, the back cushion 40 is removable, so that when the folding sofa bed 1 is unfolded, the back cushion may be removed conveniently to facilitate an unfolding operation on the folding sofa bed 1. A person skilled in the art may select a specific structure and material of the back cushion 40 as actually required, and there is no special requirement on this in this application.

In summary, this application provides the folding sofa bed. In this application, the turning component is additionally disposed between the folding bed frame body and the cushion body. When the folding sofa bed is unfolded, the cushion body may turn to be below the folding bed frame body through the turning component. This may not only save space, but also bring convenience to the user for operation.

It is to be noted that terms "include" and "comprise" or any other variation thereof is intended to cover nonexclusive inclusions herein, so that a process, method, object, or apparatus including a series of elements not only includes those elements but also includes other elements which are not clearly listed, or further includes elements intrinsic to the process, the method, the object, or the apparatus. With no more restrictions, an element defined by statement "including a/an . . . " does not exclude the existence of the same other elements in a process, method, object, or apparatus including the element.

Although the above describes the embodiments of this application with reference to the accompanying drawings, this application is not limited to the foregoing specific implementations. The foregoing specific implementations are merely exemplary but not restrictive. A person of ordinary skill in the art may be inspired by this application to implement many forms without departing from the purpose of this application and the scope of the protection of the claims, and all these shall fall within the scope of the protection of this application.

What is claimed is:

1. A folding sofa bed, comprising:

a folding bed frame body;

a cushion body, disposed above the folding bed frame body; and a turning component, connected with the folding bed frame body and the cushion body, wherein the turning component is capable of driving the cushion body above the folding bed frame body to turn to be below the folding bed frame body, when the folding bed frame body is in an unfolded state, the turning component is turnable between a first state and a second state; when the turning component is in the first state, the cushion body is above the folding bed frame body; and when the turning component is in the second state, the cushion body is below the folding bed frame body, when the folding bed frame body is in a folded state, the turning component is folded and stored between the folding bed frame body and the cushion body, the turning component comprises:

a driving member, one end being pivoted to the folding bed frame body; and a linkage member, one end being pivoted to the cushion body, while another end being pivoted to the driving member, when another end of the driving member rotates around the pivoting end of the driving member, the driving member drives, through the linkage member, the cushion body to turn, the linkage member comprises:

a first connecting rod, one end being pivoted to the cushion body, while the other end being pivoted to the driving member; and a second connecting rod, one end being pivoted to the cushion body, while the other end being pivoted to the driving member, wherein the first connecting rod and the second connecting rod are disposed side by side, a connecting rod is disposed on a side of the cushion body adjacent to the folding bed frame body, and the first connecting rod and the second connecting rod are pivoted to the connecting rod, the turning component further comprises:

a stopper, one end being pivoted to the driving member, while another end being pivoted to the folding bed frame body, wherein the stopper is configured to stop the driving member such that the driving member rotates between the first state and the second state, wherein the stopper further comprises:

a supporting rod, one end being pivoted to the driving member, wherein a middle position of the supporting rod is further pivoted to the cushion body; and a driven rod, one end being pivoted to the folding bed frame body, while the other end being pivoted to the middle position of the supporting rod, wherein when the turning component is in the second state, the other end of the supporting rod is pressed against a ground, and the supporting rod, the driven rod, and the driving member form a triangle.

2. The folding sofa bed according to claim 1, wherein the driven rod comprises a short rod and a long rod; one end of the short rod is pivoted to the folding bed frame body; the other end of the short rod is pivoted to one end of the long rod; and the other end of the long rod is pivoted to the middle position of the supporting rod.

* * * * *